US006345638B1

(12) United States Patent
Warner

(10) Patent No.: US 6,345,638 B1
(45) Date of Patent: Feb. 12, 2002

(54) MULTIPLE PEAK CABLE TENT

(75) Inventor: Gery Warner, Surrey (CA)

(73) Assignee: Tentnology Ltd., Hamilton (BM)

( * ) Notice: Subject to any disclaimer, the term of this patent is extended or adjusted under 35 U.S.C. 154(b) by 0 days.

(21) Appl. No.: 09/622,098

(22) PCT Filed: Feb. 15, 1999

(86) PCT No.: PCT/CA99/00132

§ 371 Date: Aug. 11, 2000

§ 102(e) Date: Aug. 11, 2000

(87) PCT Pub. No.: WO99/41473

PCT Pub. Date: Aug. 19, 1999

(51) Int. Cl.[7] ..... E04B 7/14

(52) U.S. Cl. ..... 135/123; 52/222; 52/82; 52/63; 52/83; 135/160; 135/908; 135/159; 135/87

(58) Field of Search ..... 52/2.25, 5, 6, 23, 52/74, 83, 82, 169.14, 198, 63, 222; 135/158, 160, 118, 124, 908, 159, 87

(56) References Cited

U.S. PATENT DOCUMENTS

| | | | | | |
|---|---|---|---|---|---|
| 1,606,658 | A | * | 11/1926 | Mills | 135/158 |
| 1,648,724 | A | * | 11/1927 | Dakin | 135/158 |
| 1,808,693 | A | * | 6/1931 | Terzoli | 135/121 |
| 1,839,076 | A | * | 12/1931 | Adams | 135/160 |
| 2,677,384 | A | * | 5/1954 | Luisada | 135/158 |
| 3,143,165 | A | | 8/1964 | Lewis et al. | |
| 3,810,481 | A | * | 5/1974 | Nohmura | 135/3 R |
| 3,888,056 | A | * | 6/1975 | Kelly et al. | 52/109 |
| 3,982,361 | A | * | 9/1976 | Deutsch et al. | 52/80 |
| 4,320,603 | A | * | 3/1982 | Kirschen | 52/18 |
| 4,450,656 | A | * | 5/1984 | Lagendijk | 52/63 |
| 4,779,635 | A | * | 10/1988 | Lynch | 135/97 |
| 5,222,513 | A | * | 6/1993 | Hilliard | 135/97 |
| 5,226,440 | A | | 7/1993 | Fuhrman | |
| 5,274,980 | A | * | 1/1994 | Zeigler | 52/646 |
| 5,634,483 | A | * | 6/1997 | Gwin | 135/131 |
| 5,711,337 | A | * | 1/1998 | McKenney | 135/121 |
| 5,784,842 | A | * | 7/1998 | Wackerbauer | 52/222 |
| 6,003,269 | A | * | 12/1999 | McRee | 52/6 |
| 6,055,999 | A | * | 5/2000 | Grey | 135/147 |
| 6,129,102 | A | * | 10/2000 | Carter | 135/145 |
| 6,134,848 | A | * | 10/2000 | Walter | 52/63 |
| 6,148,835 | A | * | 11/2000 | Rhee | 135/145 |
| 6,173,726 | B1 | * | 1/2001 | Talmadge | 135/144 |

FOREIGN PATENT DOCUMENTS

| | | |
|---|---|---|
| DE | 3243525 A1 | 5/1984 |
| DE | 3243525 | 5/1984 |
| EP | 0 161 878 | 11/1985 |
| FR | 2070983 | 8/1971 |
| FR | 2 666 612 | 3/1992 |
| FR | 2666612 | 3/1992 |
| GB | 2 267 919 A | 12/1993 |
| WO | 88/05489 | 7/1988 |

* cited by examiner

*Primary Examiner*—Robert Canfield
*Assistant Examiner*—Phi Dieu Tran A
(74) *Attorney, Agent, or Firm*—Hall, Priddy, Myers & Vande Sande

(57) ABSTRACT

A multiple peak tent (1) structure which is mechanically simple and easy to assemble. The tent structure of this invention can span relatively large areas without inhibiting mobility under the tent through the use of ground extending support poles. The canopy (3) of the multiple peak tent (1) structure is supported by multiple masts (8) resting on a cable network (11). The cable network (11) is attached to the upper corners of the frame structure resulting in a tent having no supporting poles that extend to the ground in the covered area. The multiple peak tent (1) structure may be expanded modularly to span larger areas.

16 Claims, 16 Drawing Sheets

MULTIPLE PEAK CABLE TENT

FIELD

This invention relates to a multiple peak tent structure whose top is supported by multiple masts resting on a cable network. The cable network is attached to the frame structure resulting in a tent having no supporting poles that extend to the ground in the covered area.

BACKGROUND OF THE INVENTION

The conventional designs of tent structures used to span relatively large areas often suffer from limitations induced by weight, cost, mechanical complexity and ease of erection. Further, modular designs where a plurality of single tents of a uniform design are joined to span a large area, often suffer from the additional limitations of poor mobility within the interior of the tent and poor water drainage from the roofs of the adjoined tents.

Many of the conventional designs used to span large areas, include tent structures that utilize a supporting framework of trusses or arches upon which the roof fabric is attached. Often, complex mechanical means and adjustments are necessary to introduce the pre-tensile forces required by the structure. Further, these structures are relatively complex in construction and costly to manufacture. Erecting structures of this design is labour intensive and often requires the use of specialized equipment.

Other common tent structure designs require that the interior pole, or poles, supporting the roof extend to the ground. This design results in the inhibition of free movement under the tent structure. Also, these tent structures often employ costly and complex means of introducing pre-tension into the canopy necessary to allow the tent structure to remain stable in high winds. Again, erecting a tent structure of this design is a labour intensive exercise.

A small tent manufactured and marketed by International Tentnology Corp. of Surrey, British Columbia, Canada, and sold under the trade-mark "Marquee" has overcome many of the limitations from which the designs mentioned earlier suffer. The roof of the peaked tent is supported by a pole resting on a series of cables. The cables are connected to the top of the vertical corner support poles at diagonally opposite corners of the tent. This design allows free movement under the tent without the interference of ground extending interior poles. Further, this tent design is easy to manufacture, stable in high winds and easily erected. However, this design does not allow a single tent to span relatively large areas. If a tent of this design were constructed to span a large area, the required roof height would attract high wind loads thus making it unstable. To counter the instability, the cable tension would have to be unreasonably high or the roof supporting cables would have to be lowered into the interior of the tent so far so as to cause an obstruction of the interior space.

UK Patent Application No. GB 2,267,919A issued to Teese discloses an erectable structure having a cover supported by eight rigid vertical spacers whose bottom ends are tied to a plurality of flexible tie cables.

Teese's structure is complex to erect and lacks the rigidity of a solid perimeter frame. Further, the flexible tie cables and rigid spacers of Teese's structure extend into the interior of the structure limiting the usable interior space especially near the periphery.

PcT international Publication No wo 88/05489 issued to Speare et al. discloses a tent structure having a canopy supported by foldable peripheral frame and a central mast structure. The structure disclosed by Speare et al. is complex to erect and is relatively heavy requiring a plurality of solid beams and supports to tension the canopy. Speare et al. does not disclose a canopy support structure that consists simply of a cable network supported from the peripheral frame by radially directed cables. The cable network of Speare does not itself provide vertical support to a canopy. Further, the structure disclosed by Speare et al. requires the use of storm cables to stabilize the structure in windy conditions. These storm cable cause substantial obstruction of the interior space of the structure.

European Patent Application EP-A-0161878 issued to Geiger et al. discloses a cable truss dome constructed of a plurality of arched support members arranged radially around a central ring forming a dome covering a space such as a stadium or arena. The structure disclosed by Geiger et al . depends on the closely radially spaced cables which connect between the ring and the perimeter frame and several struts or compression members between the perimeter frame and the ring to support the roof canopy. The structure of Geiger et al. cannot be rodularly expanded and is designed to cover extremely large areas such as stadiums and arenas.

It is, therefore, an object of this invention to provide a tent structure that is mechanically simple, easy to manufacture and easy to erect.

It is a further object of this invention to provide; tent structure that allows free movement under the canopy without the interference of ground extending poles.

It is a further object of this invention to provide tent structure that car be modularly expanded.

It is a further object of this invention to provide a tent structure with a low wind profile and excellent water shedding.

It is a further object of this invention to provide a tent structure with a drainage system integrated into the frame.

SUMMARY OF THE INVENTION

These and other objects of the invention are provided in an improved tent structure which includes a perimeter frame preferably assembled from a plurality of perimeter frame members and corner assemblies, a flexible roof canopy attached around its periphery to the perimeter frame, corner columns attached to the perimeter frame, a cable network comprising radially directed cables attached at one end of the perimeter frame and at the other end to a centrally disposed cable, and a plurality of flying masts resting on the cable network and supporting the roof canopy thereby forming the peaks.

The centrally disposed cable can be detachable secured to itself. Utilizing the cable network, it is relatively easy to erect the tent structure and tension the canopy; the ends of the centrally disposed cabke are simply brought together and secured. Also, the cable network reduces the tension necessary to support the flying masts as compared to diagonally connected cables. Multiple flying masts allow the load of the roof canopy to be distributed over several masts resulting in the flying masts being smaller in size and shorter in length than a single mast, thereby contributing to the tent structure's ease of erection and lower wind profile. Further, the cable network allows the flying masts to be located away from the center and towards the corners of the tent structure permitting the tent structure to span a larger area than would be possible with only a single large mast.

Located in the corner assemblies of the tent structure are scuppers. Rain water flows from the roof canopy, along the perimeter frame to the corners of the tent structure. The rainwater is channeled into the scuppers of the corner assemblies, then down through the hollow center of the corner columns to the ground. This provides the tent structure with a gutter system which prevents the pooling of water on the roof canopy of the tent structure and channels the rain water away from the edges of the tent structure.

The tent structure of the above described design can be modularly expanded in order to span relatively large areas.

Other objects and advantages of the invention will become clear from the following detailed description of the preferred embodiment, which is presented by way of illustration only and without limiting the scope of the invention to the details thereof.

BRIEF DESCRIPTION OF THE DRAWINGS

Further features and advantages will be apparent from the following detailed description, given by way of example, of a preferred embodiment taken in conjunction with the accompanying drawings, wherein.

DETAILED DESCRIPTION OF THE INVENTION

Throughout the figures, like elements are indicated by like reference numbers.

Figure 1:
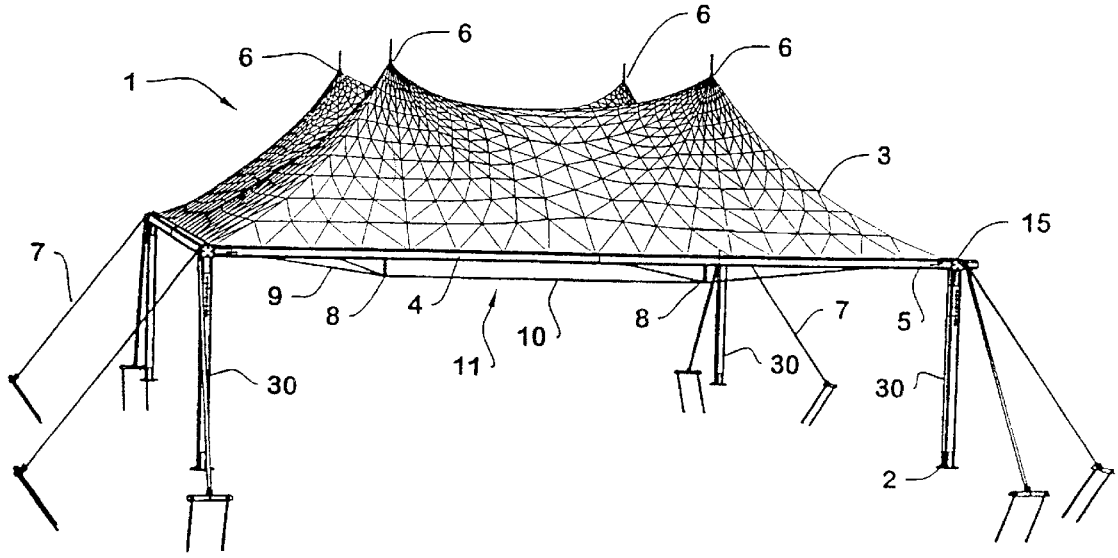
FIG. 1 is a perspective view of an assembled tent

Referring to FIG. 1, the tent structure 1 is comprised of a roof canopy 3, a perimeter frame 5, a cable network 11, column members 30 and flying masts 8.

The roof canopy 3 is a flexible fabric membrane whose 4 outer edges form a rectangular shape. Extending along the entire length of each of the outer edges of the roof canopy 3 is a beaded edge 21 (see FIG. 2). The beaded edge 21 functions to secure the roof canopy 3 to perimeter frame members 4 of the perimeter frame 5. The interior surface of the roof canopy 3 has 4 receptacles (not shown). Each receptacle is located where a peak in the roof canopy 3 is to be formed and each receptacle is designed to receive one end of one of the flying masts 8.

Figure 2:
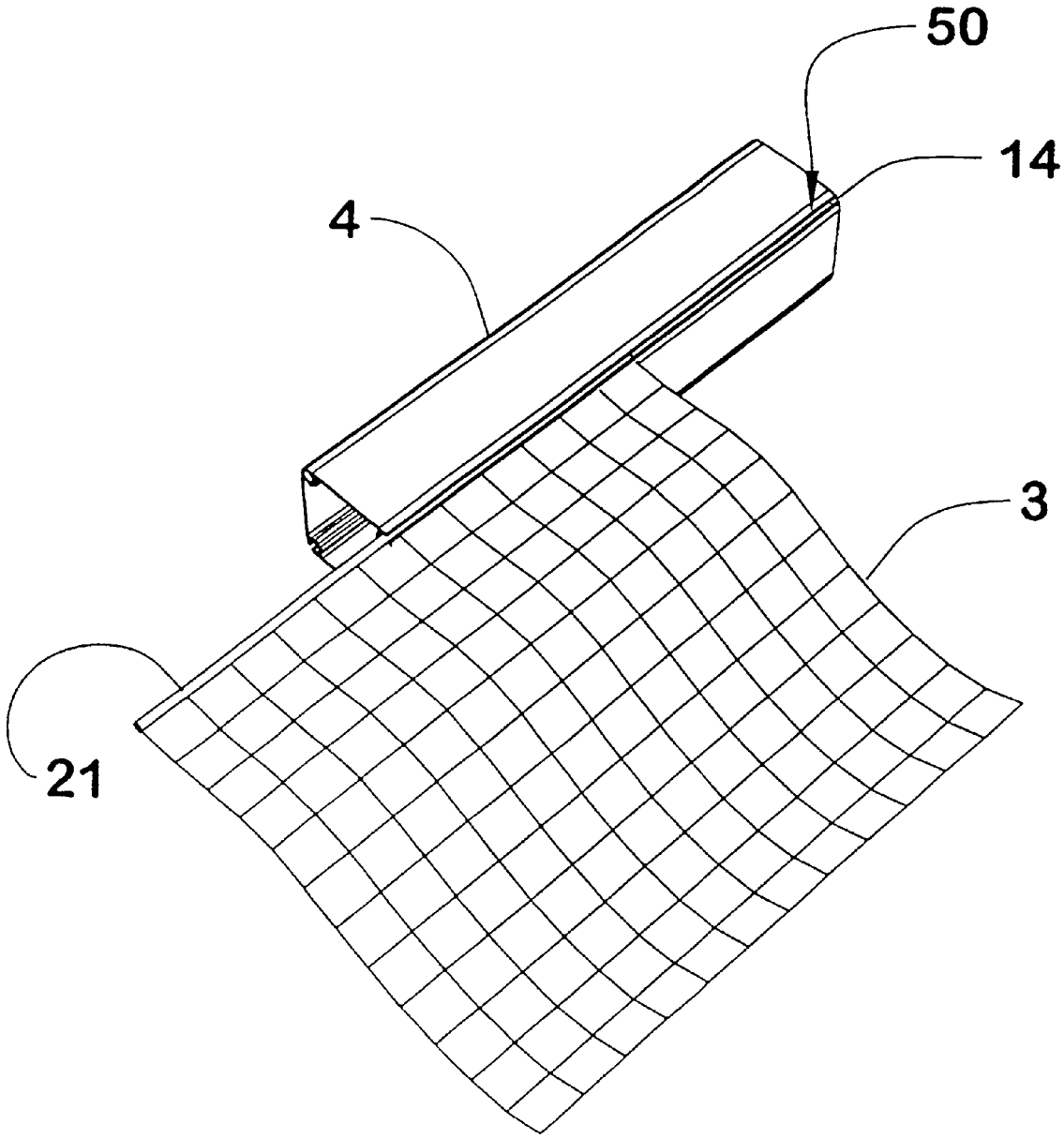
FIG. 2 is a perspective view of a portion of a frame element being threaded by a beaded edge of a portion of a canopy.
Figure 3:
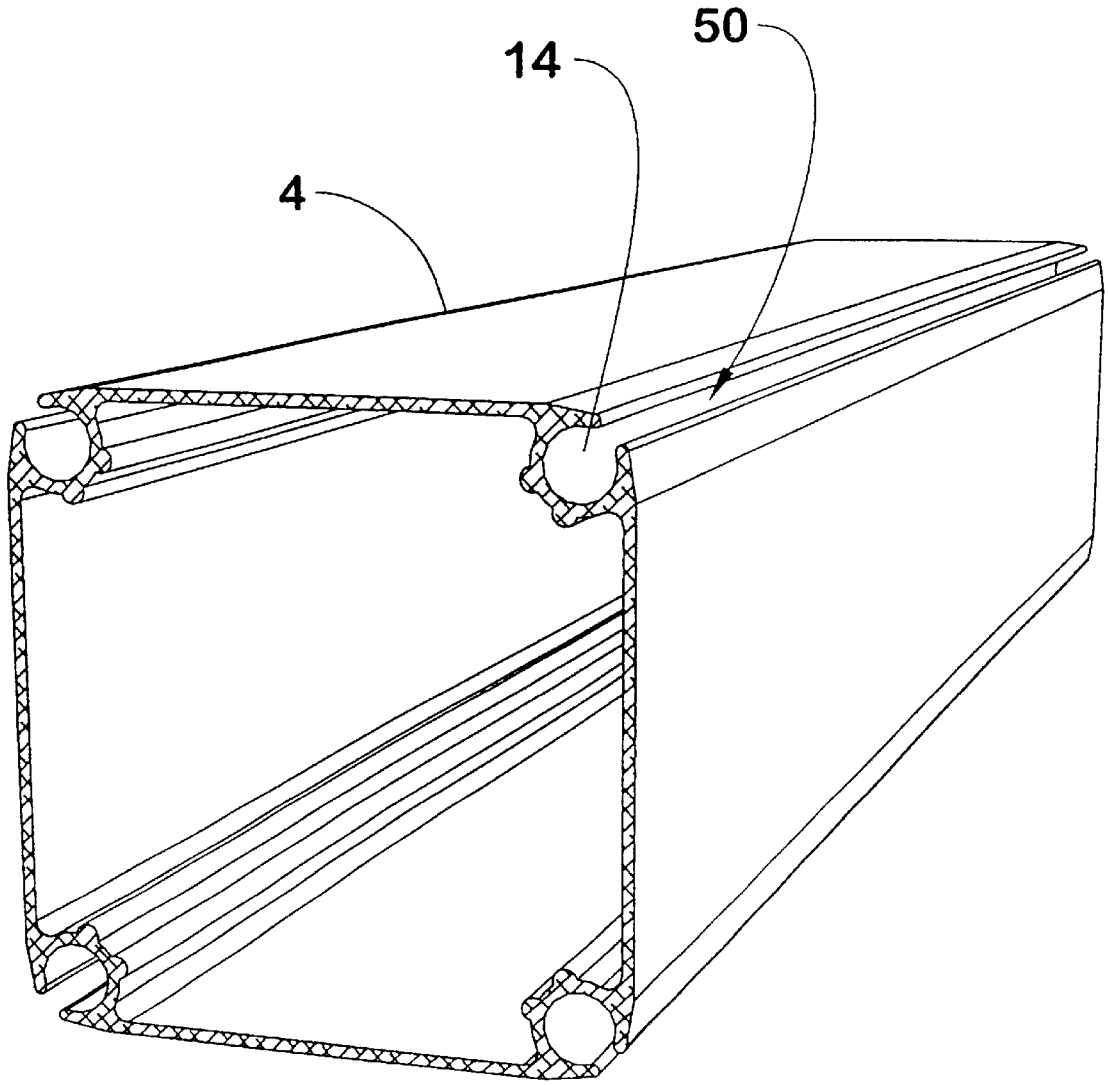
FIG. 3 is a perspective view of a portion of a perimeter frame member used for the perimeter frame and the corner columns.

The perimeter frame members 4 of the perimeter frame 5 operably connect with a plurality of the corner assemblies 15 to form a rectangular shape. Referring to FIG. 3, perimeter frame member 4 is comprised of a tube of square cross section, open at both ends, with elongated channels 14 and channel openings 50 which extend along the edges of the tube for its entire length. Referring to FIG. 2, channel 14 receives a beaded edge 21 of roof canopy 3 such that the roof canopy 3 extends from the beaded edge 21 through channel opening 50 with the engagement of the beaded edge 21 by the sides of the channels 14 allowing tensioning of roof canopy 3.

Figure 4:
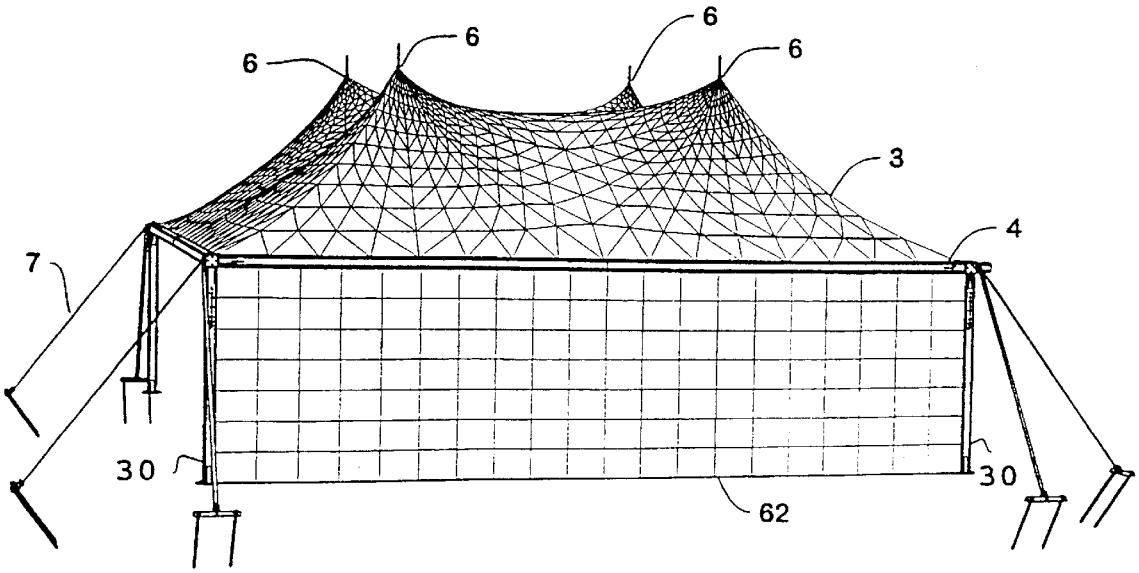
FIG. 4 is a perspective view of a tent structure with a wall membrane.

Referring to FIG. 4, a wall membrane 62 with beaded edges (not shown) may be installed to close a side of the tenet structure 1. The column members 30 have the same construction as perimeter frame members 4, thereby allowing installation of a wall membrane 62 through engagement of the beaded edges of the wall membrane 62 with the channels 14 of the column membranes 30 and the perimeter frame members 4.

Figure 5:
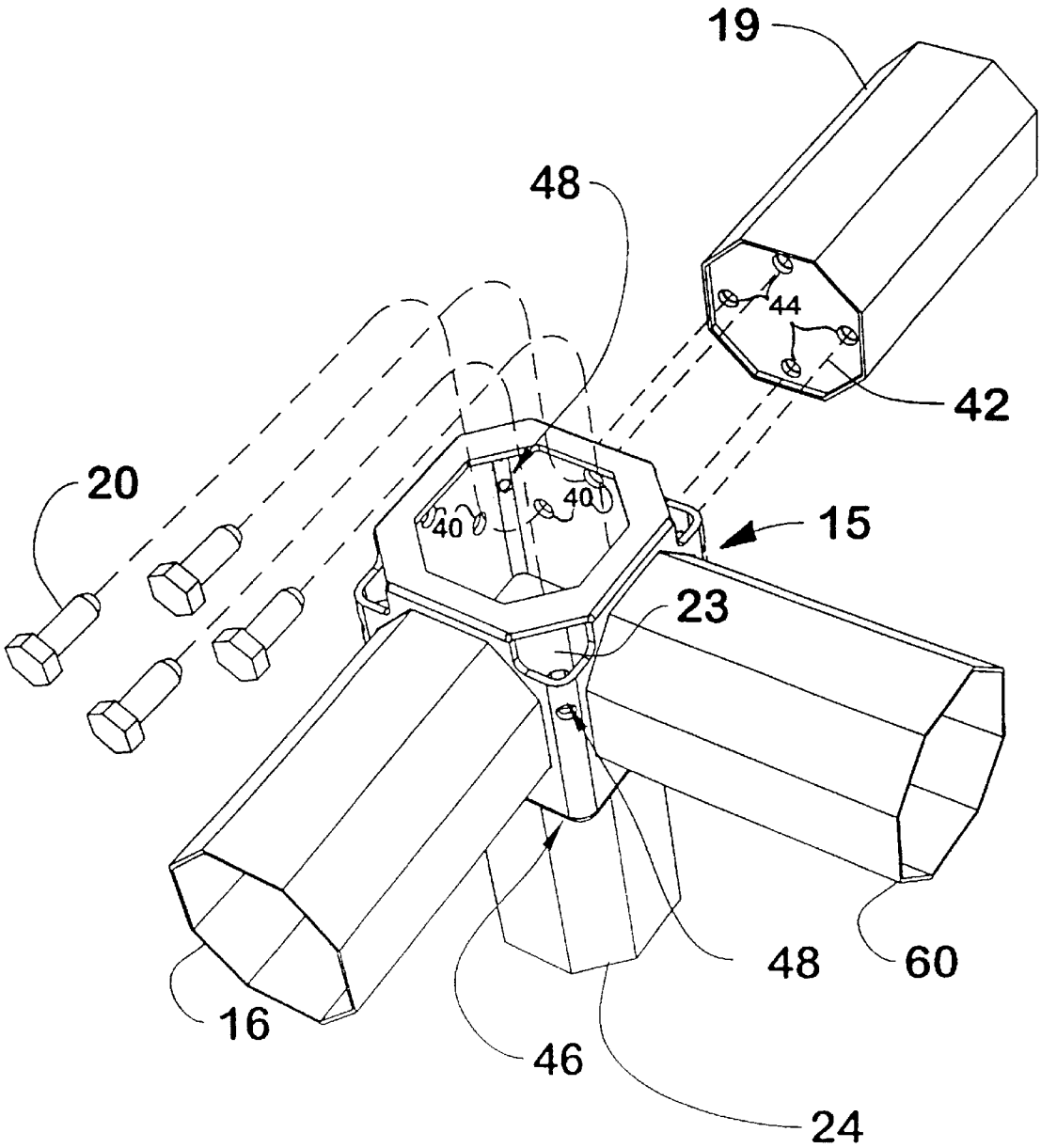
FIG. 5 is a perspective view of the corner assembly.
Figure 6:
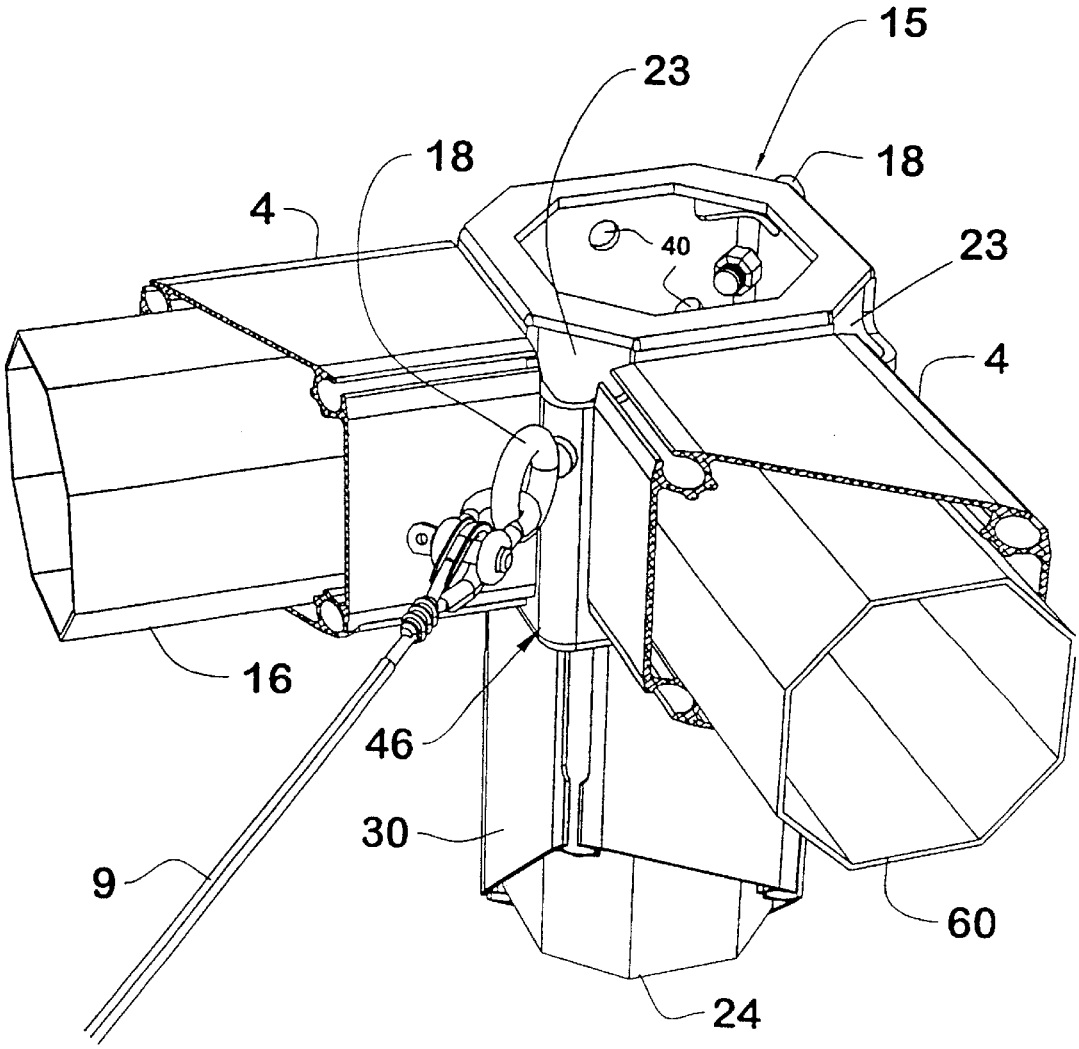
FIG. 6 is a perspective view of the corner assembly showing a portion of the perimeter frame members fitted over octagonal frame member connectors.

Referring to FIGS. 5 and 6, corner assembly 15 has a top, bottom and four sides. Corner assembly 15 includes two frames member connectors 16 and 60, and a corner column connector 24. The frame member connectors 16 and 60, and the corner column connector 24 are tubes of octagonal cross-section open at both ends. One end of each of the two frame member connectors 16 and 60 is welded to a side of the corner assembly 15 such that the two frame member connectors 16 and 60 are arranged perpendicular to one another. One end of the corner column connector 24 is welded around its periphery to the bottom of the corner assembly 15 in a way such that water can pass from the corner assembly 15 through corner column connector 24.

Referring to FIG. 6, the octagonal cross-section of the frame member connectors 16 and 60 in combination with the square cross-section of the perimeter frame members 4 when the frame member connectors 16 and 60 are securably inserted into an end of the perimeter frame members 4, prevents the rotation of the perimeter frame members 4 around the frame member connectors 16 and 60.

Figure 7:
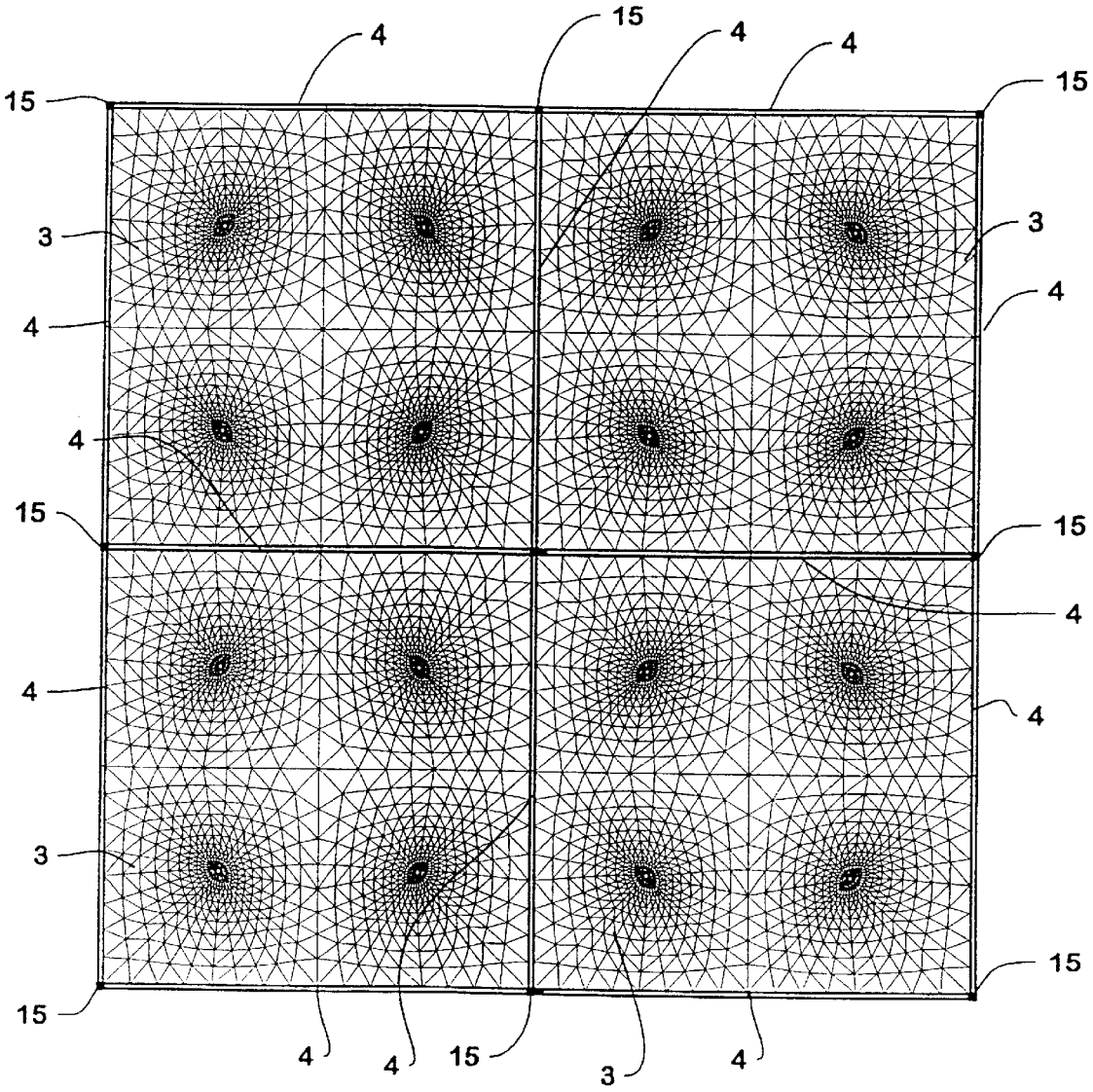
FIG. 7 is a plan view of a plurality of tent structures modularly connected.
Figure 8:
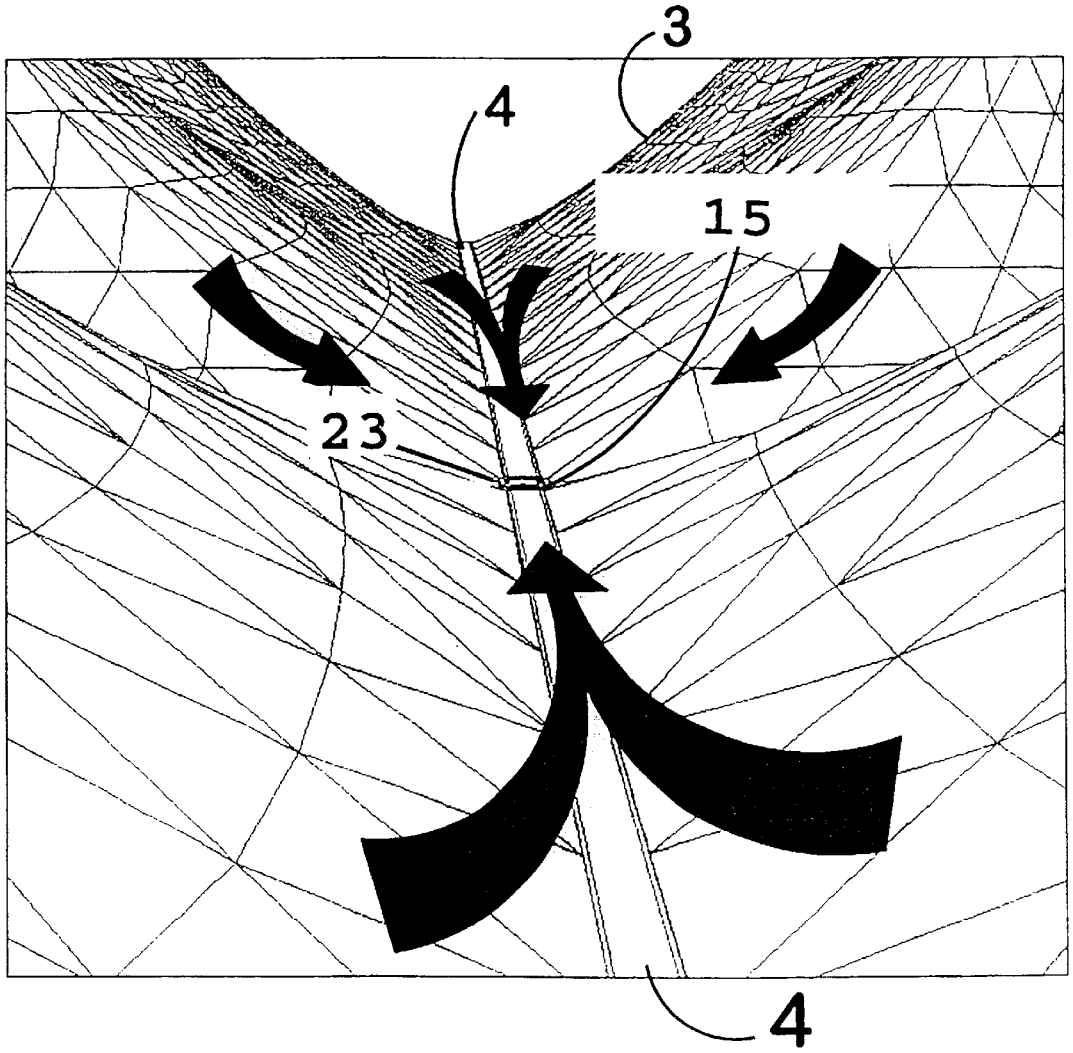
FIG. 8 is a perspective view of a portion of four tent structures modularly connected and indicating the flow of rain water to the scupper of the corner assembly.
Figure 9:
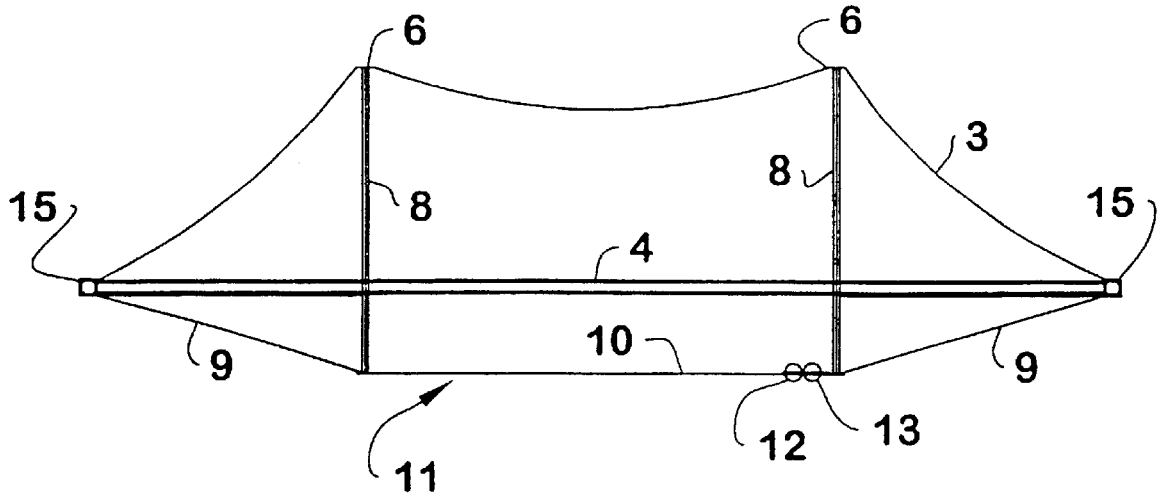
FIG. 9 is a partial elevation view showing the perimeter frame, flying masts and cable network for a roof canopy that is tensioned.
Figure 10:
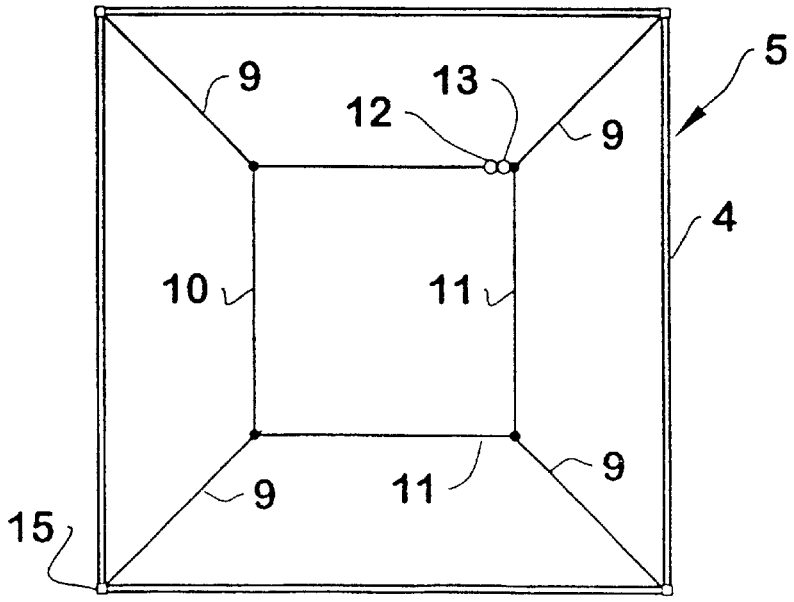
FIG. 10 is a bottom view of the perimeter frame and cable network for a roof canopy that is tensioned.
Figure 11:
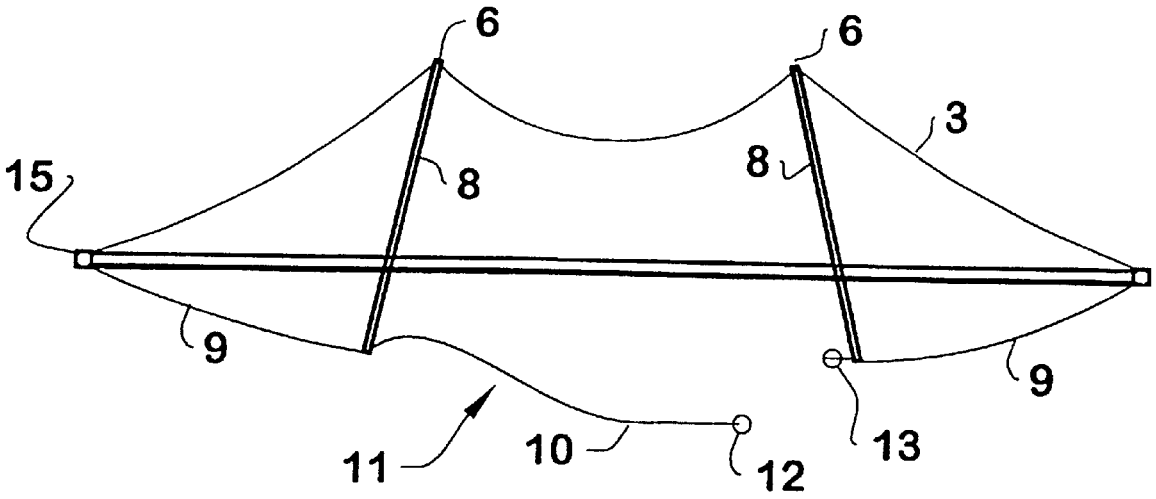
FIG. 11 is a partial elevation view showing the perimeter frame, flying masts and cable network for a roof canopy that is not tensioned.
Figure 12:
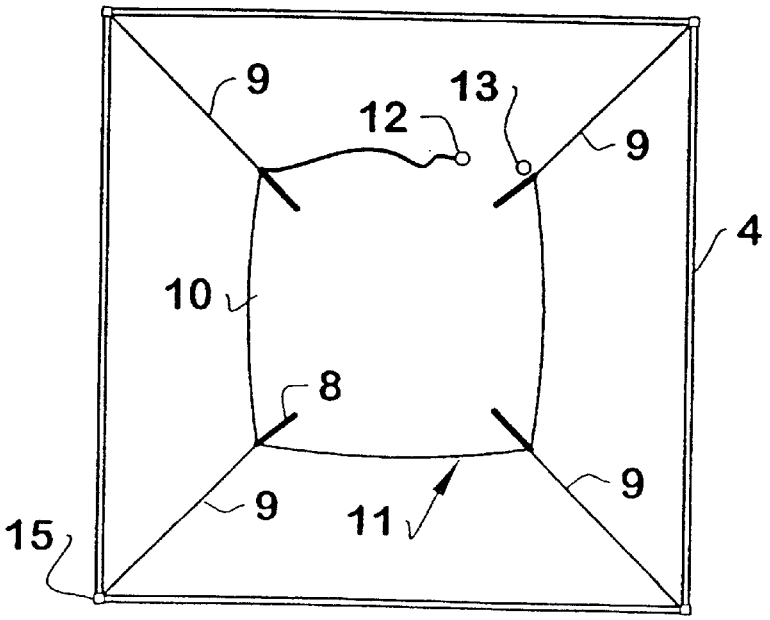
FIG. 12 is a bottom view of the perimeter frame and cable network for a roof canopy that is not tensioned.

The two sides of corner assembly 15 that do not have frame member connectors 16 and 60 welded to them, may have a plurality of bolt holes 40 which are used to attach expansion connectors 19 to corner assembly 15 to complete the assembly of the perimeter frame 5 (see FIG. 15) of a single tent structure 1 or to modularly connect several tent structures 1 (see FIGS. 7 and 8). Expansion connector 19 is comprised of a tube of octagonal cross-section, to one end of which an octagonal plate 42 is welded. Octagonal plate 42 may have a plurality of threaded holes 44 to secure expansion connector 19 to the corner assembly 15 by way of bolts 20. However, expansion connector 19 may be secured to corner assembly 15 by any means that confers sufficient strength to the union.

On the corner assemblies 15, are the scuppers 23 and the cable attachment eye holes 48. The scuppers 23 are openings at the top of corner assemblies 15 that receive rainwater from the roof canopy 3 and perimeter frame members 4 (see FIG. 8), and channel it down through corner column connector 24 and column member 30 (FIG. 6) to the ground. The cable attachment eye holes 48 (FIG. 5) serve as the sites to secure a cable attachment eye 18 (FIG. 6). A radially directed cable 9 may be connected to an interiorly facing cable attachment eye 18 to be used in the formation of a cable network 11. A guy line 7 may be connected between an exteriorly facing cable attachment eye 18 and the ground to offset forces which would tend to deform the perimeter frame 5 (see FIG. 1).

Referring to FIGS. 9–12, the cable network 11 is comprised of radially directed cables 9 and centrally disposed cable 10 formed into a rectangle. Radially directed cables 9 include a connector at one end to secure that end of the radially directed cable 9 to the cable attachment eye 18 of one of the corner assemblies 15 and a connector at the other end to operably connect that end of the radially directed cable 9 to the centrally disposed cable 10. Centrally disposed cable 10 includes a first end 12 and a second end 13 such that the centrally disposed cable 10 can be detachably secured unto itself to form a continuous loop when first end 12 and second end 13 are engaged.

Figure 15A:
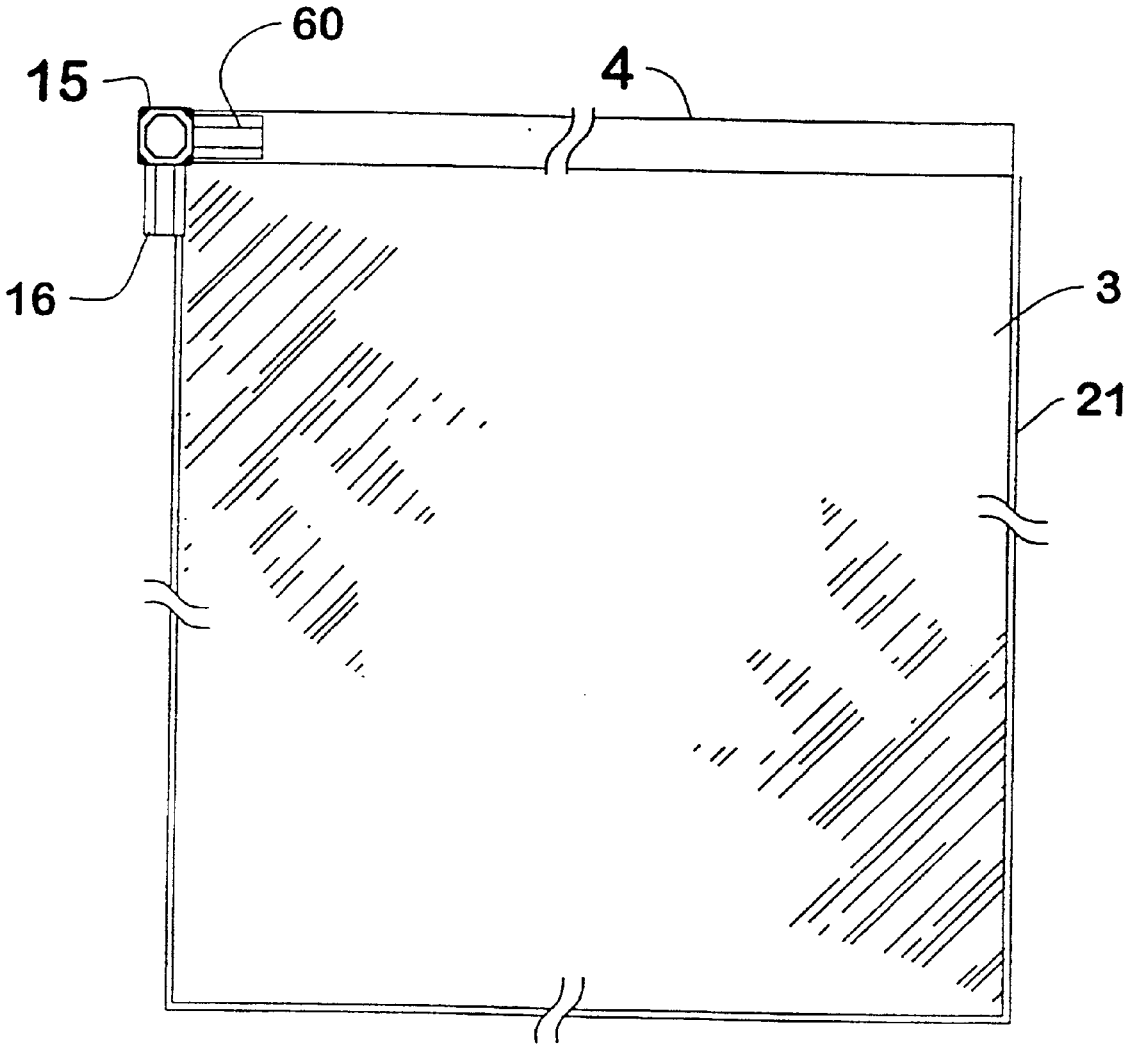
FIGS. 15*a–d* are plan views of the roof canopy and perimeter frame showing the steps in assembled the perimeter frame onto and around the roof canopy.
Figure 15B:
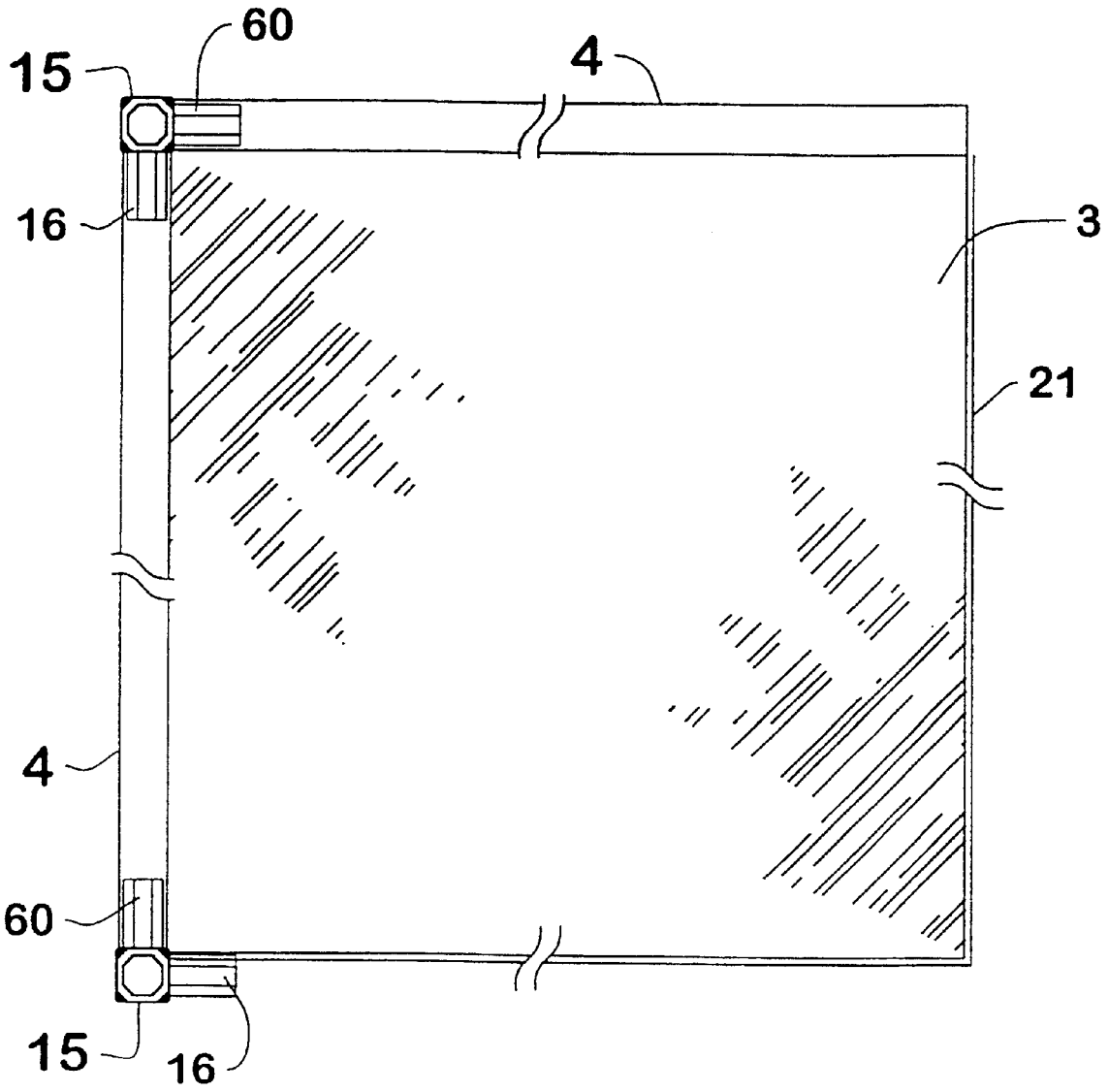
Figure 15C:
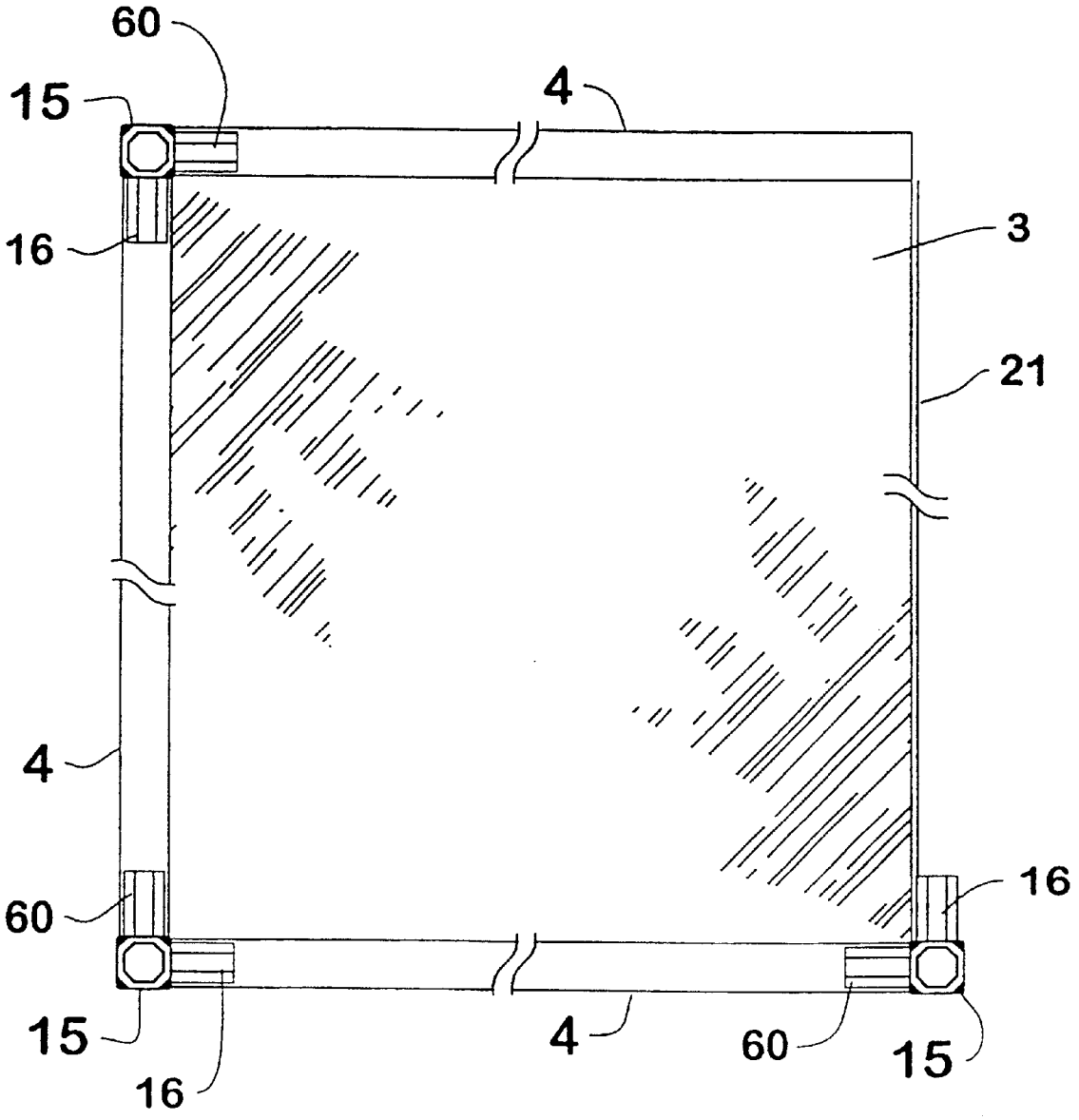
Figure 15D:
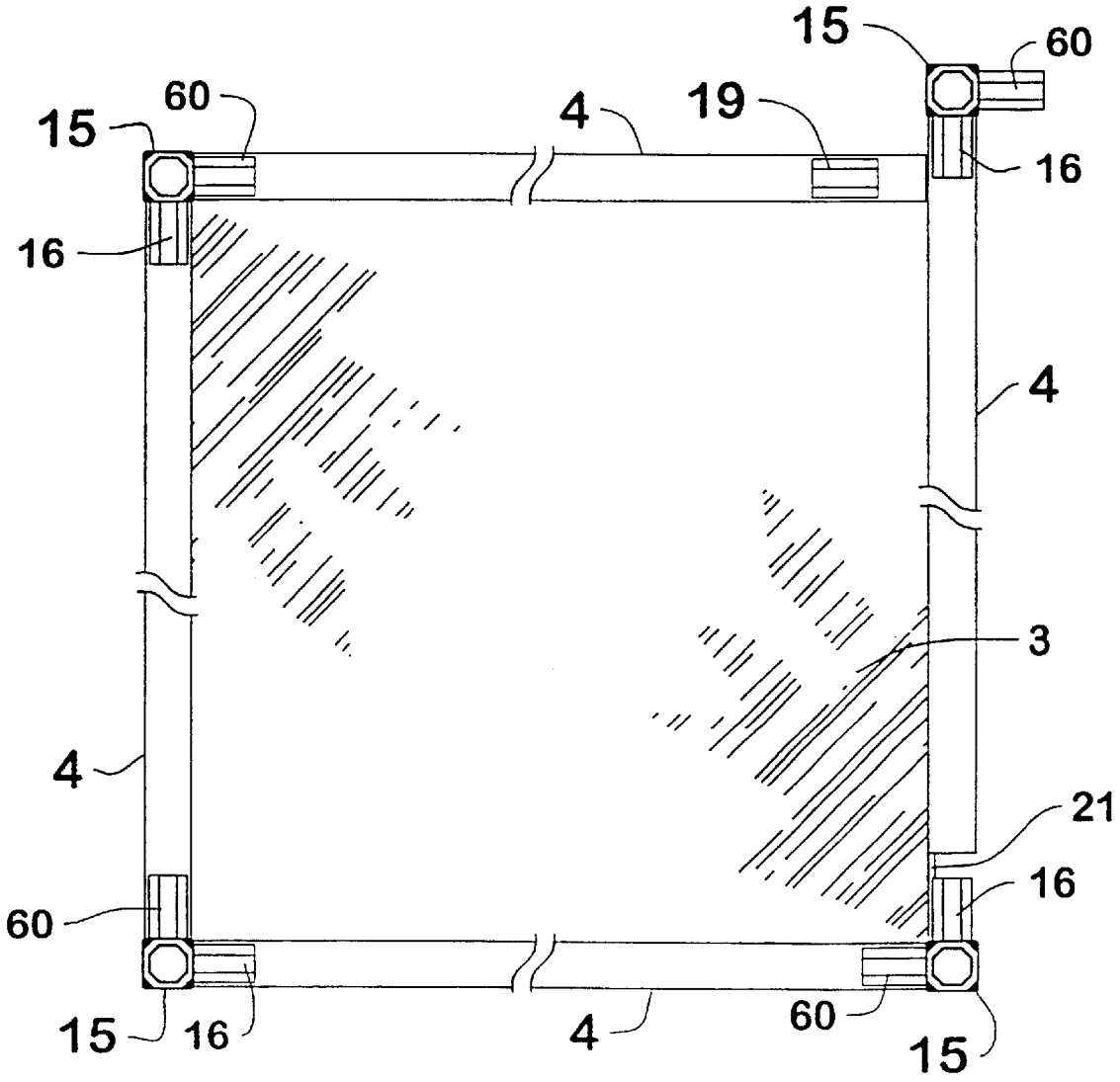
Figure 16:
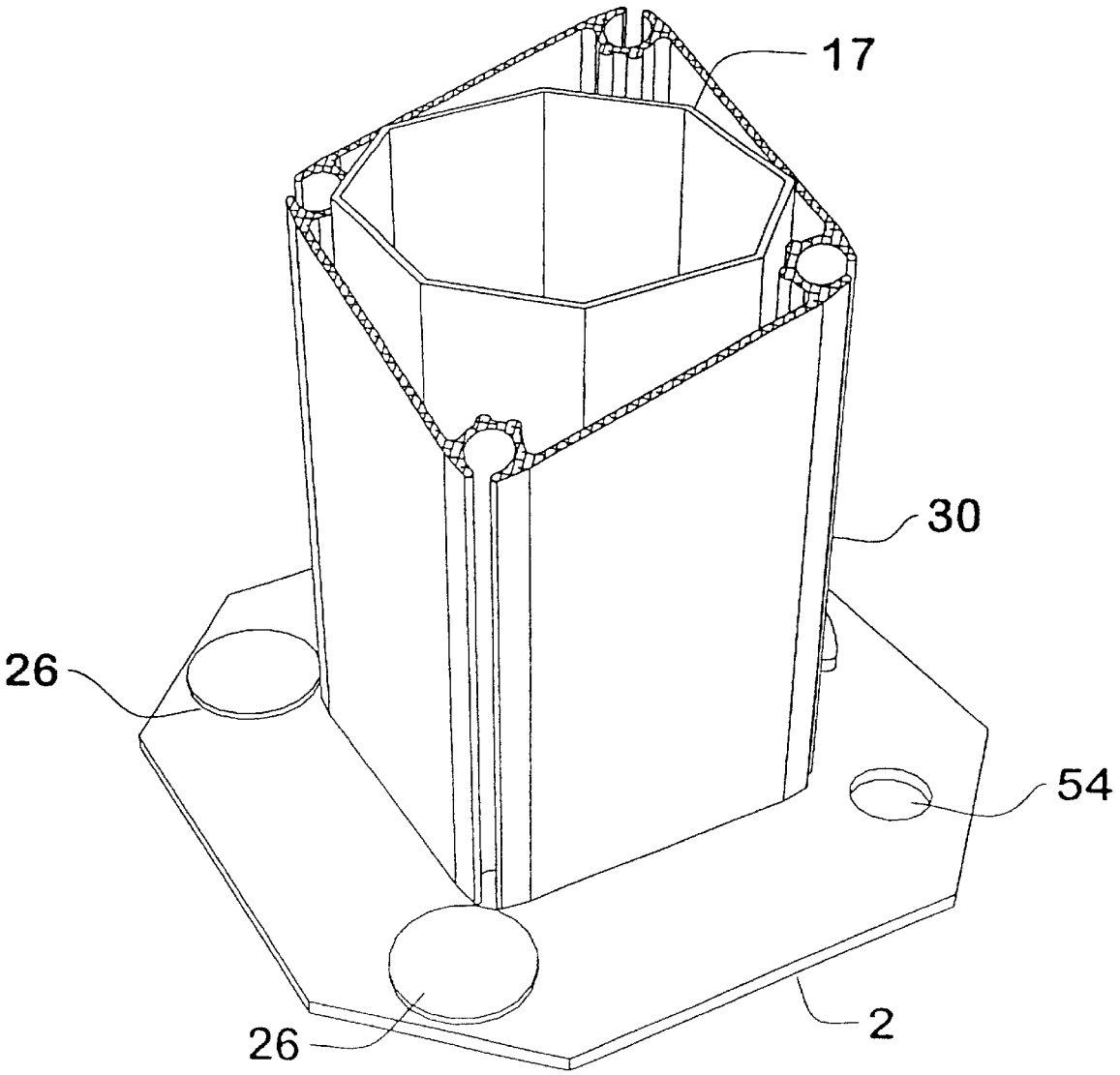
FIG. 16 is a perspective view of a corner column fitted over a base plate connector of a base plate.

The tent structure 1 of this invention may be assembled and erected in the following manner. Referring to FIGS. 2, 13, 14 and 15 *a–d*, assembly of the tent structure 1 initially requires that the roof canopy 3 be secured to the perimeter frame members 4 of the perimeter frame 5. This is accomplished by threading the beaded edge 21 of one of the outside edges of roof canopy 3 into the channel 14 of a first perimeter frame member 4 by sliding it along the entire length of perimeter frame member 4 (as seen in FIGS. 2 and 15*a*). Frame member connector 60 of the first corner assembly 15 is securably inserted into one end of the first perimeter frame member 4 so that member connector 16 of the first corner assembly 15, is oriented parallel to an adjacent edge of the roof canopy 3 and the corner column connector 24 is oriented downwardly towards the ground.

A second perimeter frame member 4 is then threaded onto the beaded edge 21 of an adjacent side of the roof canopy 3 and slid along its length until frame member connector 16 of the first corner assembly 15 is securably inserted into the end of the second perimeter frame member 4.

Similarly, frame member connector 60 of a second corner assembly 15 is securably inserted into the open end of the second perimeter frame member 4 (see FIG. 15*b*) and a third perimeter frame member 4 is then threaded onto the beaded edge 21 of an adjacent side of the roof canopy 3 and slid along its length until frame member connector 16 of the second corner assembly 15 is securably inserted into the end of the third perimeter frame member 4.

Again, frame member connector 60 of a third corner assembly 15 is securably inserted into the open end of the third perimeter frame member 4 (see FIG. 15*c*) and a fourth perimeter frame member 4 is then threaded onto the beaded edge 21 of an adjacent side of the roof canopy 3 and slid along its length until frame member connector 16 of the third corner assembly 15 is securably inserted into the end of the fourth perimeter frame member 4.

After the fourth perimeter frame member has been threaded along the beaded edge 21 of the roof canopy 3, an expansion connector 19 is securably inserted into the empty end of the first perimeter frame member 4. Frame member connector 16 of a fourth corner assembly 15 is securably inserted into the empty end of the fourth perimeter frame member 4 so that frame member connector 60 of the fourth corner assembly 15 is oriented towards the exterior of the tent structure 1 and parallel to the first perimeter frame member 4 (see FIG. 15*d*). The expansion connector 19 is then secured to the fourth corner assembly 15 to complete the perimeter frame 5.

Figure 13:
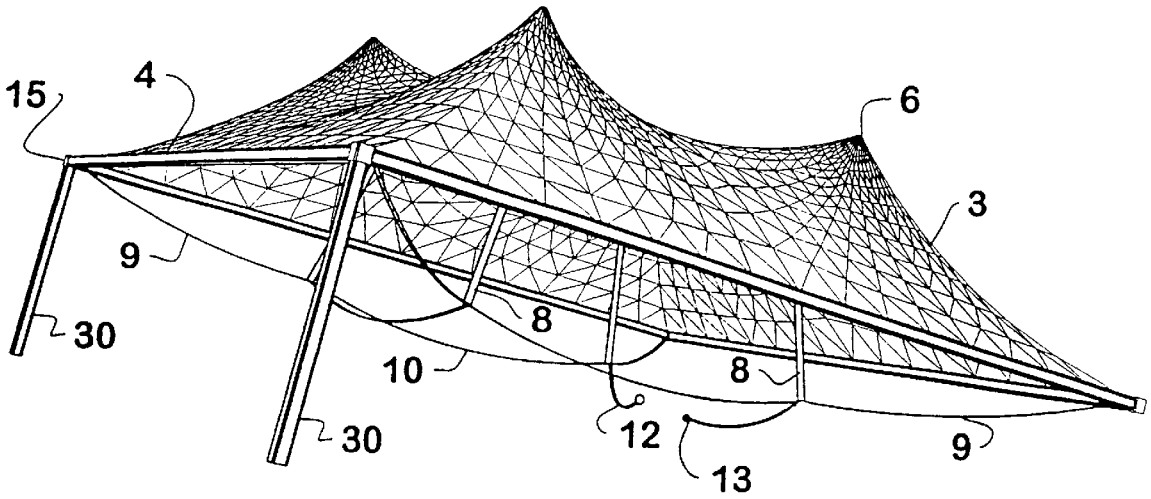
FIG. 13 is a perspective view of the tent structure with the connectors of the centrally disposed cable detached and the roof canopy not tensioned.
Figure 14:
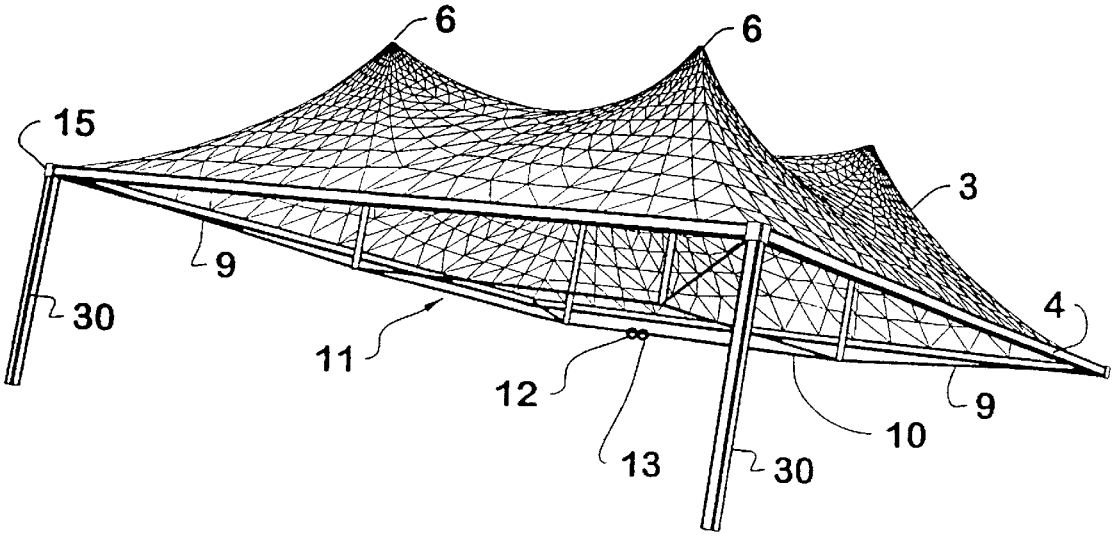
FIG. 14 is a perspective view of the tent structure with the connectors of the centrally disposed cable attached and the roof canopy not tensioned.

Referring to FIG. 13, to aid in assembly the cable network 11, one end of the perimeter frame 5 may be raised and a column member 30 may be secured over the corner column connector 24 of each of the two corner assemblies 15, which are raised.

Referring to FIGS. 9–14, the next step in the assembly and erection of the tent structure 1, is the assembly of the cable network 11. Each radially directed cable 9 has one end secured to the cable attachment eye 18 of a corner assembly 15 and the other end to the centrally disposed cable 10. Each of the flying masts 8 are positioned such that one end is coupled to a junction of the radially directed cable 9 and the centrally disposed cable 10, and the other end is received into a receptable (not shown) in the roof canopy 3. Once the flying masts 8 are in place, the ends of the centrally disposed cable 10, are brought together such that a first end 12 is engaged with s second end 13 to detachably secure the ends of centrally disposed cable 10 thereby tensioning the entire tent structure 1.

Referring to FIG. 1 again, once the tenet structure 1 has been tensioned, the remaining column members 30 are secured to the corner assemblies 15, to raise the perimeter frame 5 from the ground. Guy lines 7 are coupled between the exterior facing cable attachment eye 18 and the ground to relieve the compressive beam stress introduced into the perimeter frame 5 by the cable network 11 and the roof canopy 3. Guy lines 7 also serve to add lateral strength and anchor the tent structure 1.

Prior to securing a column member 30 to a corner column connector 24 of a corner assembly 15, a base plate connector 17 of a base plate 2 (see FIG. 13) may be securably inserted into the end of the column member 30 that is to come in contact with the ground. The pin holes 54 in the base plate 2 receive drift pins 26 which anchor the base plate 2 to the ground and prevent column members 30 from drifting.

As seen in FIGS. 7 and 8, tent structure 1 may be expanded modularly through the use of the expansion connectors 19. Securing expansion connectors 19 to the corner assemblies 15 allows the tent structure 1 to be expanded modularly from any or all of its four sides.

While a square or rectangular structure for the perimeter frame 5 has been described, the same design or any other geometry in which the sides can be joined to create an array of such structures joined along their side edges.

Similarly, while the frame member connectors 16 and 60, the expansion connector 19 and the corner column connector 24 have been described as having an octagonal cross-section, and the fame member 4 and corner columns 30 have been described as having a square cross-section, any shape of non-circular cross-section may be used such that the frame members 4 and the corner columns 30 do not rotate about their axes when coupled with the appropriate connector in response to torque resulting from the tensioning of the roof canopy 3.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within true scope of the invention.

I claim:

1. A tent structure (1) comprising:

a) a perimeter frame (5) having a form of a closed planar geometric shape;

b) a roof canopy (3) having edges couplable to said perimeter frame (5);

c) a cable network (11) comprising a plurality of radially directed cables (9) and a centrally disposed cable (10), wherein each one of said plurality of radially directed cables (9) is couplable at one end to said perimeter frame (5) and at another end to said centrally disposed cable (10);

d) a plurality of flying masts (8) positionable between said cable network (11) and said roof canopy (3) to fully tension said roof canopy(3); and e) a plurality of column members (30) couplable to said perimeter frame (5) and operative to support said perimeter frame (5) in an elevated position relative to a support surface.

2. The tent structure (1) according to claim 1, wherein a first end of said centrally disposed cable (10) is couplable to a second end of said centrally disposed cable (10).

3. The tent structure (1) according to claim 1, wherein said perimeter frame (5) is comprised of a plurality of perimeter frame members (4) and a plurality of corner assemblies (15), each one of said plurality of perimeter frame members (4) coupled to respective ones of said plurality of corner assemblies (15) to form a closed geometric shape.

4. The tent structure (1) according to claim 3, wherein said plurality of column members (30) are couplable to said corner assemblies (15).

5. The tent structure (1) according to claim 1, wherein a base plate (2) is secured to a ground contacting end of each of said column members (30).

6. The tent structure (1) according to claim 3, wherein said roof canopy (3) includes a beaded edge (21) around its periphery and said perimeter frame members (4) of said perimeter frame (5) include a plurality of spaced-apart elongated channels (14) extending longitudinally along said frame members such that said roof canopy (3) is coupled to said perimeter frame members (4) of said perimeter frame (5) through insertion of said beaded edge (21) of said roof canopy (3) into said channels (14) of said perimeter frame members (4) of said perimeter frame (5).

7. The tent structure (1) according to claim 3, wherein each of said corner assemblies (15) includes scuppers (23) to accept water from said roof canopy (3) and said perimeter frame members (4), and channel the water down through each of said column members (30).

8. The tent structure (1) according to claim 3, wherein each of said corner assemblies (15) includes a corner column connector (24) operative to engage a column member (30) and at least two frame member connectors (16, 60) which engage said perimeter frame members (4) to form said perimeter frame (5).

9. The tent structure (1) according to claim 8, wherein each of said frame member connectors (16, 60) has a non-circular cross-section and each of said perimeter frame members (4) has a complementary cross-section such that said perimeter frame members (4) cannot rotate along their axes when coupled with said frame member connectors (16, 60) in response to tensioning of said roof canopy (3).

10. The tent structure (1) according to claim 8, wherein said corner assemblies (15) include expansion connectors (19) which may be secured to said corner assemblies (15) to expand said tent structure (1) modularly.

11. The tent structure (1) according to claim 6, wherein said channels (14) of said perimeter frame members (4) secure an edge of a roof canopy of an adjacent tent structure.

12. A tent structure (1) according to claim 8, wherein each of said corner column connectors (24) has a non-circular cross-section and each of said column members (30) has a complementary cross-section such that said column members (30) cannot rotate along their axes when coupled with said corner column connectors (24) in response to tensioning of said roof canopy (3).

13. A tent structure (1) according to claim 3, wherein at least one of said plurality of perimeter frame members (4) is also a perimeter frame member of an adjacent tent structure.

14. A tent structure (1) according to claim 9, wherein said frame member connectors (16, 60) have an octagonal cross-section.

15. A tent structure (1) according to claim 12, wherein said corner column connectors (24) have an octagonal cross-section.

16. A tent structure (1) according to claim 6, wherein a wall membrane (62) with a beaded edge (21) is coupled to said tent structure (1) by threading said beaded edge (21) of said wall membrane (62) into a channel (14) of a perimeter frame member (4).

* * * * *